US012129575B2

(12) United States Patent
Cook et al.

(10) Patent No.: US 12,129,575 B2
(45) Date of Patent: Oct. 29, 2024

(54) CONTROLLING THE DEGREE OF SWELLING OF POLYMER FIBERS DURING COAGULATION

(71) Applicant: Cytec Industries Inc., Princeton, NJ (US)

(72) Inventors: John Desmond Cook, Simpsonville, SC (US); Suzanne Crawford, Anderson, SC (US); Varun Kumar, Greenville, SC (US); Thomas Taylor, Greenville, SC (US); Jeremy Moskowitz, Mauldin, SC (US)

(73) Assignee: Cytec Industries Inc., Princeton, NJ (US)

( * ) Notice: Subject to any disclaimer, the term of this patent is extended or adjusted under 35 U.S.C. 154(b) by 752 days.

(21) Appl. No.: 17/278,367

(22) PCT Filed: Sep. 26, 2019

(86) PCT No.: PCT/US2019/053261
§ 371 (c)(1),
(2) Date: Mar. 22, 2021

(87) PCT Pub. No.: WO2020/069195
PCT Pub. Date: Apr. 2, 2020

(65) Prior Publication Data

US 2021/0348304 A1 Nov. 11, 2021

Related U.S. Application Data

(60) Provisional application No. 62/736,534, filed on Sep. 26, 2018.

(51) Int. Cl.
*D01F 9/22* (2006.01)
*D01D 5/06* (2006.01)

(52) U.S. Cl.
CPC ..... *D01F 9/22* (2013.01); *D01D 5/06* (2013.01); *D10B 2101/12* (2013.01)

(58) Field of Classification Search
CPC .... D01F 9/22; D01F 6/18; D01D 5/06; D10B 2101/12
See application file for complete search history.

(56) References Cited

U.S. PATENT DOCUMENTS

| | | | | |
|---|---|---|---|---|
| 4,113,683 | A * | 9/1978 | Kalnin | C08L 79/04 264/129 |
| 5,011,644 | A * | 4/1991 | Haruta | D01F 11/00 264/211.14 |
| 6,641,915 | B1 | 11/2003 | Kasabo et al. | |
| 2005/0181206 | A1 * | 8/2005 | Endo | D01F 6/14 428/364 |
| 2016/0186365 | A1 | 6/2016 | Taylor | |
| 2016/0263803 | A1 * | 9/2016 | Cook | D01F 9/22 |

FOREIGN PATENT DOCUMENTS

| | | |
|---|---|---|
| CN | 103290527 A | 9/2013 |
| CN | 103556235 A | 2/2014 |

OTHER PUBLICATIONS

Kolthoff, et al., Acid-Base Strength in Demethyl Sulfoxide, Inorganic Chemistry 1962; 1(2): 189-194 (Year: 1962).*
Sahoo, et al., pH-Responsive Fibers Based on Acrylonitrile Acrylic Acid Block Copolymers: Effect of Spinning Conditions and Postspinning Operations on Response and Mechanical Properties, Journal of Applied Polymer Science 2008; 109: 3792-3803 (Year: 2008).*
Walczak, Process Fiber Formation, Chapter VII, pp. 256-295 (Elsevier Science Ltd. 2002) (Year: 2002).*

* cited by examiner

*Primary Examiner* — Daniel C. McCracken
(74) *Attorney, Agent, or Firm* — Osha Bergman Watanabe & Burton LLP

(57) ABSTRACT

The present disclosure relates to the control of the degree of swelling of polymer fiber, such as polymer fiber used in the manufacturing of composite materials, by control of the pH of the coagulation bath during spinning.

15 Claims, No Drawings

CONTROLLING THE DEGREE OF SWELLING OF POLYMER FIBERS DURING COAGULATION

CROSS REFERENCE TO RELATED APPLICATIONS

This application is a U.S. national phase entry under 35 U.S.C. § 371 of International Application No. PCT/US2019/053261, filed on Sep. 26, 2019, which claims the priority of U.S. Provisional Application No. 62/736,534, filed Sep. 26, 2018. The entire contents of these applications are explicitly incorporated herein by this reference.

FIELD OF THE INVENTION

The present disclosure relates generally to controlling the degree of swelling of polymer fibers by controlling coagulation bath pH during the production of polymer fiber. The production of such polymer fiber may be incorporated into a process for producing carbon fiber, typically carbon fiber used in manufacturing composite materials.

BACKGROUND

Carbon fibers have been used in a wide variety of applications because of their desirable properties, such as high strength and stiffness, high chemical resistance and low thermal expansion. For example, carbon fibers can be formed into a structural part that combines high strength and high stiffness, while having a weight that is significantly lighter than a metal component of equivalent properties. Increasingly, carbon fibers are being used as structural components in composite materials for aerospace and automotive applications, among others. In particular, composite materials have been developed wherein carbon fibers serve as a reinforcing material in a resin or ceramic matrix.

Carbon fiber from acrylonitrile is generally produced by a series of manufacturing steps or stages, including polymerization, spinning, drawing and/or washing, oxidation, and carbonization. Polyacrylonitrile (PAN) polymer is currently the most widely used precursor for carbon fibers.

During the precursor spinning process, polymer dope is generally brought into contact with a coagulation bath. Typically, a diffusional interchange occurs between the two phases in which solvent leaves the forming filament as water enters, causing the polymer to phase separate from the solvent and precipitate. A solid fibrillar network is then formed during this period of densification. The inherent nature of the fibrillar structure of the coagulated fiber has a major influence on the tensile properties, abrasion strength, and other mechanical properties of the finished polymer precursor. These properties are then translated to the resulting carbon fiber.

The "denseness" of the coagulated fiber is a property that has an influence on one or more properties of the finished polymer precursor and is related to the degree of swelling of the polymer fiber. The degree of swelling represents the amount of liquid within the fiber. A low water content corresponds to a denser fiber structure while a high water content corresponds to a less dense fiber structure. When the degree of swelling is too high, final tensile performance can decrease, thus making the coagulation process a critical process. Typically, parameters such as polymer dope pH, concentration, and viscosity have been used to predict the coagulation bath concentration needed to establish a dense fiber structure. However, in many cases, the measured degree of swelling of the coagulated fiber may not be as predicted, leading to uncertainties in the properties of the finished polymer precursor.

Thus, there is an ongoing need for ways of altering the degree of swelling of polymer fibers in a controlled manner, particularly during the manufacture of polymer fibers used for making carbon fiber.

SUMMARY OF THE INVENTION

It has been discovered that is possible to alter the degree of swelling of polymer fibers by controlling the coagulation bath pH during the production of polymer fiber.

Thus, in a first aspect, the present disclosure relates to a process for producing polymer fibers, the process comprising:

a) spinning a polymer solution into a coagulation bath; and b) maintaining the pH of the coagulation bath at a level effective to produce polymer fibers having a degree of swelling of less than or equal to 150%, typically less than or equal to 135%.

In a second aspect, the present disclosure relates to a process for producing carbon fibers, the process comprising:

a') producing carbon fiber precursor fibers according to the process described herein;

b') drawing the carbon fiber precursor fibers through one or more draw and wash baths, thereby forming drawn carbon fiber precursor fibers that are substantially free of solvent; and c') oxidizing the drawn carbon fiber precursor fibers of step b') to form stabilized carbon fiber precursor fibers and then carbonizing the stabilized carbon fiber precursor fiber, thereby producing carbon fibers.

In a third aspect, the present disclosure relates to a method for controlling the degree of swelling of a polymer fiber, the method comprising adjusting the pH of the coagulation bath during spinning of the polymer fiber.

DETAILED DESCRIPTION

As used herein, the terms "a", "an", or "the" means "one or more" or "at least one" and may be used interchangeably, unless otherwise stated.

As used herein, the term "comprises" includes "consists essentially of" and "consists of." The term "comprising" includes "consisting essentially of" and "consisting of."

The first aspect of the present disclosure relates to a process for producing polymer fibers, the process comprising:

a) spinning a polymer solution into a coagulation bath; and b) maintaining the pH of the coagulation bath at a level effective to produce polymer fibers having a degree of swelling of less than or equal to 150%, typically less than or equal to 135%.

Prior to step a) of spinning the polymer solution into a coagulation bath, the polymer solution is first prepared. Preparing the polymer solution may be achieved according to any method known to those of ordinary skill in the art. One suitable method is a method in which the polymer is formed in a medium, typically one or more solvents, in which the polymer is soluble to form a solution.

Another suitable method is a method in which the polymer is formed in a medium, typically aqueous medium, in which the polymer is sparingly soluble or non-soluble to form a mixture, isolating the resulting polymer, for example, by filtration, and dissolving the resulting polymer in one or more solvents to form a polymer solution.

The polymer is typically a polyacrylonitrile-based (PAN) polymer comprising repeating units derived from acrylonitrile.

The polymer may further comprise repeating units derived from other comonomers. Such repeating units may be derived from suitable comonomers including, but not limited to, vinyl-based acids, such as methacrylic acid (MAA), acrylic acid (AA), and itaconic acid (ITA); vinyl-based esters, such as methacrylate (MA), ethyl acrylate (EA), butyl acrylate (BA), methyl methacrylate (MMA), ethyl methacrylate (EMA), propyl methacrylate, butyl methacrylate, β-hydroxyethyl methacrylate, dimethylaminoethyl methacrylate, 2-ethylhexylacrylate, isopropyl acetate, vinyl acetate (VA), and vinyl propionate; vinyl amides, such as vinyl imidazole (VIM), acrylamide (AAm), and diacetone acrylamide (DAAm); vinyl halides, such as allyl chloride, vinyl bromide, vinyl chloride and vinylidene chloride; ammonium salts of vinyl compounds and sodium salts of sulfonic acids, such as sodium vinyl sulfonate, sodium p-styrene sulfonate (SSS), sodium methallyl sulfonate (SMS), and sodium-2-acrylamido-2-methyl propane sulfonate (SAMPS), among others.

The polymer can be made by any polymerization method known to those of ordinary skill in the art. Exemplary methods include, but are not limited to, solution polymerization, dispersion polymerization, precipitation polymerization, suspension polymerization, emulsion polymerization, and variations thereof.

One suitable method comprises mixing a first monomer, typically acrylonitrile (AN) monomer, and a second monomer, typically a co-monomer described herein, in a solvent in which the polymer is soluble, thereby forming a solution. The solution is heated to a temperature above room temperature (i.e., greater than 25° C.), for example, to a temperature of about 40° C. to about 85° C. After heating, an initiator is added to the solution to initiate the polymerization reaction. Once polymerization is completed, unreacted AN monomers are stripped off (e.g., by de-aeration under high vacuum) and the resulting PAN polymer solution is cooled down. At this stage, the polymer is in a solution, or dope, form.

Examples of suitable solvents include, but are not limited to, dimethyl sulfoxide (DMSO), dimethyl formamide (DMF), dimethyl acetamide (DMAc), ethylene carbonate (EC), zinc chloride ($ZnCl_2$)/water and sodium thiocyanate (NaSCN)/water.

In another suitable method, the first monomer, typically acrylonitrile (AN) monomer, and the second monomer, typically a co-monomer described herein, may be polymerized in a medium, typically aqueous medium, in which the resulting polymer is sparingly soluble or non-soluble. In this manner, the resulting polymer would form a heterogenous mixture with the medium. The polymer is then filtered and dried.

The comonomer ratio (amount of one or more comonomers to amount of acrylonitrile) is not particularly limited. However, a suitable comonomer ratio is 0 to 20%, typically 1 to 5%, more typically 1 to 3%.

Suitable initiators (or catalysts) for the polymerization include, but are not limited to, azo-based compounds, such as azo-bisisobutyronitrile (AIBN), 2,2'-azobis[2-(2-imidazolin-2-yl)propane]dihydrochloride, 2,2'-azobis(2-methylpropionamidine)dihydrochloride, 2,2'-azobis[N-(2-carboxyethyl)-2-methylpropionamidine]tetrahydrate, 2,2'-azobis[2-(2-imidazolin-2-yl)propane], 2,2'-azobis[2-methyl-N-(2-hydroxyethyl)propionamide], 4,4'-azobis(4-cyanovaleric acid), 2,2'-azobis-(2,4-dimethyl) valeronitrile (ABVN), among others; and organic peroxides, such as dilauroyl peroxide (LPO), di-tert-butyl peroxide (TBPO), diisopropyl peroxydicarbonate (IPP), among others.

After the polymer solution is prepared, the polymer fibers are then formed by spinning the polymer solution into a coagulation bath.

The polymer solution (i.e., spin "dope") may be subjected to conventional wet spinning and/or air-gap spinning after removing air bubbles by vacuum. The spin dope can have a polymer concentration of at least 10 wt %, typically from about 16 wt % to about 28 wt % by weight, more typically from about 19 wt % to about 24 wt %, based on total weight of the solution.

In wet spinning, the dope is filtered and extruded through holes of a spinneret (typically made of metal) into the liquid coagulation bath for the polymer to form filaments. The spinneret holes determine the desired filament count of the fiber (e.g., 3,000 holes for 3K carbon fiber).

In air-gap spinning, a vertical air gap of 1 to 50 mm, typically 2 to 10 mm, is provided between the spinneret and the coagulating bath. In this spinning method, the polymer solution is filtered and extruded in the air from the spinneret and then extruded filaments are coagulated in a coagulating bath.

In an embodiment, the step of spinning a polymer solution into a coagulation bath comprises air gap spinning the polymer solution into the coagulation bath.

The coagulation liquid used in the process is a mixture of solvent and non-solvent. Water or alcohol is typically used as the non-solvent. Suitable solvents include the solvents described herein. In an embodiment, dimethyl sulfoxide, dimethyl formamide, dimethyl acetamide, or mixtures thereof, is used as solvent. In another embodiment, dimethyl sulfoxide is used as solvent. The ratio of solvent and non-solvent, and bath temperature are not particularly limited and may be adjusted according to known methods to achieve the desired solidification rate of the extruded nascent filaments in coagulation. However, the coagulation bath typically comprises 40 wt % to 85 wt % of one or more solvents, the balance being non-solvent, such as water or alcohol. In an embodiment, the coagulation bath comprises 40 wt % to 70 wt % of one or more solvents, the balance being non-solvent. In another embodiment, the coagulation bath comprises 50 wt % to 85 wt % of one or more solvents, the balance being non-solvent.

Typically, the temperature of the coagulation bath is from 0° C. to 80° C. In an embodiment, the temperature of the coagulation bath is from 30° C. to 80° C. In another embodiment, the temperature of the coagulation bath is from 0° C. to 20° C.

It has been discovered that the pH of the coagulation bath affects the degree of swelling in a correlative manner. Thus, according to the process of the present disclosure, the pH of the coagulation bath is maintained at a level effective to produce polymer fibers having a degree of swelling of less than or equal to 150%, typically less than or equal to 135%.

In an embodiment, the pH of the coagulation bath is maintained at a level effective to produce polymer fibers having a degree of swelling in a range from 90 to 150%, typically 95 to 135%, more typically 95 to 105%.

The pH of the coagulation bath is maintained at about 4 to about 12, typically about 6 to about 11, more typically about 10 to about 11.

In some embodiments, the pH of the coagulation bath is about 4 to about 12 and the degree of swelling is in a range from 90 to 150%, or the pH of the coagulation bath is about 6 to about 11 and the degree of swelling is in a range from 95 to 135%, or the pH of the coagulation bath is about 10 to about 11 and the degree of swelling is in a range from 95 to 105%.

The pH of the coagulation bath and, therefore, the degree of swelling, may be maintained by any manner known to those having ordinarily skill in the art. However, one suitable method of maintaining the pH of the coagulation bath at a level effective to produce polymer fibers having the said degree of swelling, comprises:

b1) determining the degree of swelling of the produced polymer fibers;

b2) adjusting the pH of the coagulation bath to achieve the said degree of swelling; and b3) optionally, repeating steps b1) and b2).

The degree of swelling is determined by any suitable method known to those of ordinary skill. In one suitable method, samples are collected and submerged in a container, such as glass beaker or flask, containing deionized water, and "washed" for a minimum of 15 minutes. After this time, the deionized water is removed from the container and disposed of in the appropriate waste receptacle. Once the final wash is completed, the samples are centrifuged to remove the adhered liquid from the precursor fiber surface. The samples are centrifuged at 3,000 rpm for 15 minutes. After the centrifuge cycle is complete, samples are weighed on an analytical balance and the weight recorded ($W_a$).

Samples are then placed in an air circulating oven at 110° C. for 3 hours. Following drying, samples are removed from the oven and placed in a desiccator for a minimum of ten minutes. The dried and desiccated samples are re-weighed and the weight recorded ($W_f$). The degree of swelling can then be calculated using the following relation:

$$\text{Degree of swelling } (\%)=(W_a-W_f)\times(100/W_f),$$

wherein $W_a$ is the weight obtained after washing and centrifuging and $W_f$ is the weight obtained after drying the sample at 110° C. for 3 hours.

Adjusting the pH of the coagulation bath to achieve the said degree of swelling comprises adding acid or base to the coagulation bath.

Any acid that is capable of providing $H^+$ ions or cause the formation of $H^+$ ions, typically in aqueous solutions, is suitable for use in the processes of the present disclosure. Suitable acids include inorganic acids and organic acids. Examples of inorganic acids include, but are not limited to, hydrochloric acid, nitric acid, sulfuric acid, hydrobromic acid, hydroiodic acid, perchloric acid, chloric acid, phosphoric acid, nitrous acid, hydrofluoric acid, and the like. Examples of organic acids include, but are not limited to, formic acid, acetic acid, trifluoracetic acid, and the like. The acid may be provided neat or as a solution, typically aqueous solution. In an embodiment, the acid is an inorganic acid, typically sulfuric acid.

Any base that is capable of providing $^-OH$ ions, cause the formation of $^-OH$ ions, or sequester $H^+$ ions, typically in aqueous solutions, is suitable for use in the processes of the present disclosure. Suitable bases include, but are not limited to, metal hydroxides and ammonia. Examples of metal hydroxides include, but are not limited to, alkali metal hydroxides, such as LiOH, NaOH, KOH, RbOH, and CsOH; alkaline earth metal hydroxides, such as $Mg(OH)_2$, $Ca(OH)_2$, $Sr(OH)_2$, and $Ba(OH)_2$; Group 13 hydroxides, such as $B(OH)_3$ and $Al(OH)_3$; and the like.

It would be apparent to a person of ordinary skill in the art that the steps of determining the degree of swelling of the produced polymer fibers and/or adjusting the pH of the coagulation bath to achieve the desired degree of swelling may optionally be repeated any number of times.

Generally, fibers with a degree of swelling greater than or equal 135% contain macrovoids, which lower the performance and tensile properties of the final carbon fiber formed from such fibers. However, in addition to controlling the degree of swelling of the produced polymer fibers, it has also been found that adjusting the pH of the coagulation bath can reduce or eliminate the formation of macrovoids.

Thus, in an embodiment, the produced polymer fibers are substantially free of macrovoids. As used herein, "substantially free" means that the amount of macrovoids are below the detection limit of methods generally used to observe macrovoids, such as, for example, optical microscopy.

The polymer fibers produced are carbon fiber precursor fibers. The term "precursor fiber" refers to a fiber comprising a polymeric material that can, upon the application of sufficient heat, be converted into a carbon fiber having a carbon content that is about 90% or greater, and in particular about 95% or greater, by weight.

The second aspect of the present disclosure relates to a process for producing carbon fibers, the process comprising:

a') producing carbon fiber precursor fibers according to the process described herein;

b') drawing the carbon fiber precursor fibers through one or more draw and wash baths, thereby forming drawn carbon fiber precursor fibers that are substantially free of solvent; and c') oxidizing the drawn carbon fiber precursor fibers of step b') to form stabilized carbon fiber precursor fibers and then carbonizing the stabilized carbon fiber precursor fiber, thereby producing carbon fibers.

The drawing of the carbon fiber precursor fibers is conducted by conveying the spun precursor fibers through one or more draw and wash baths, for example, by rollers. The carbon fiber precursor fibers are conveyed through one or more wash baths to remove any excess solvent and stretched in hot (e.g., 40° C. to 100° C.) water baths to impart molecular orientation to the filaments as the first step of controlling fiber diameter. The result is drawn carbon fiber precursor fibers that are substantially free of solvent.

In an embodiment, the carbon fiber precursor fibers are stretched from −5% to 30%, typically from 1% to 10, more typically from 3 to 8%.

Step b') of the process may further comprise drying the drawn carbon fiber precursor fibers that are substantially free of solvent, for example, on drying rolls. The drying rolls can be composed of a plurality of rotatable rolls arranged in series and in serpentine configuration over which the filaments pass sequentially from roll to roll and under sufficient tension to provide filaments stretch or relaxation on the rolls. At least some of the rolls are heated by pressurized steam, which is circulated internally or through the rolls, or electrical heating elements inside of the rolls. Finishing oil can be applied onto the stretched fibers prior to drying in order to prevent the filaments from sticking to each other in downstream processes.

Step b') may optionally further comprise determining the degree of swelling of the drawn carbon fiber precursor fibers, and adjusting the degree of swelling of the drawn carbon fiber precursor fibers to a desired level by modifying certain process parameters known to affect degree of swelling, such as, for example, the amount of total baths, stretches, temperatures, and filament speeds.

In step c') of the process described herein, the drawn carbon fiber precursor fibers of step b') are oxidized to form stabilized carbon fiber precursor fibers and, subsequently, the stabilized carbon fiber precursor fiber are carbonized to produce carbon fibers.

During the oxidation stage, the drawn carbon fiber precursor fibers, typically PAN fibers, are fed under tension through one or more specialized ovens, each having a temperature from 150 to 300° C., typically from 200 to 280° C., more typically from 220 to 270° C. Heated air is fed into each of the ovens. Thus, in an embodiment, the oxidizing in step c') is conducted in an air environment. The drawn carbon fiber precursor fibers are conveyed through the one or more ovens at a speed of from 4 to 100 fpm, typically from 30 to 75 fpm, more typically from 50 to 70 fpm.

The oxidation process combines oxygen molecules from the air with the fiber and causes the polymer chains to start crosslinking, thereby increasing the fiber density to 1.3 $g/cm^3$ to 1.4 $g/cm^3$. In the oxidization process, the tension applied to fiber is generally to control the fiber drawn or shrunk at a stretch ratio of 0.8 to 1.35, typically 1.0 to 1.2. When the stretch ratio is 1, there is no stretch. And when the stretch ratio is greater than 1, the applied tension causes the fiber to be stretched. Such oxidized PAN fiber has an infusible ladder aromatic molecular structure and it is ready for carbonization treatment.

Carbonization results in the crystallization of carbon molecules and consequently produces a finished carbon fiber that has more than 90 percent carbon content. Carbonization of the oxidized, or stabilized, carbon fiber precursor fibers occurs in an inert (oxygen-free) atmosphere inside one or more specially designed furnaces. In an embodiment, carbonizing in step c') is conducted in a nitrogen environment. The oxidized carbon fiber precursor fibers are passed through one or more ovens each heated to a temperature of from 300° C. to 1650° C., typically from 1100° C. to 1450° C.

In an embodiment, the oxidized fiber is passed through a pre-carbonization furnace that subjects the fiber to a heating temperature of from about 300° C. to about 900° C., typically about 350° C. to about 750° C., while being exposed to an inert gas (e.g., nitrogen), followed by carbonization by passing the fiber through a furnace heated to a higher temperature of from about 700° C. to about 1650° C., typically about 800° C. to about 1450° C., while being exposed to an inert gas. Fiber tensioning may be added throughout the precarbonization and carbonization processes. In pre-carbonization, the applied fiber tension is sufficient to control the stretch ratio to be within the range of 0.9 to 1.2, typically 1.0 to 1.15. In carbonization, the tension used is sufficient to provide a stretch ratio of 0.9 to 1.05.

Adhesion between the matrix resin and carbon fiber is an important criterion in a carbon fiber-reinforced polymer composite. As such, during the manufacture of carbon fiber, surface treatment may be performed after oxidation and carbonization to enhance this adhesion.

Surface treatment may include pulling the carbonized fiber through an electrolytic bath containing an electrolyte, such as ammonium bicarbonate or sodium hypochlorite. The chemicals of the electrolytic bath etch or roughen the surface of the fiber, thereby increasing the surface area available for interfacial fiber/matrix bonding and adding reactive chemical groups.

Next, the carbon fiber may be subjected to sizing, where a size coating, e.g. epoxy-based coating, is applied onto the fiber. Sizing may be carried out by passing the fiber through a size bath containing a liquid coating material. Sizing protects the carbon fiber during handling and processing into intermediate forms, such as dry fabric and prepreg. Sizing also holds filaments together in individual tows to reduce fuzz, improve processability and increase interfacial shear strength between the fiber and the matrix resin.

Following sizing, the coated carbon fiber is dried and then wound onto a bobbin.

A person of ordinary skill in the art would understand that other processing conditions (including composition of the spin solution and coagulation bath, the amount of total baths, stretches, temperatures, and filament speeds) are correlated to provide filaments of a desired structure and denier. The process of the present disclosure may be conducted continuously.

Carbon fibers produced according to the process described herein may be characterized by mechanical properties, such as tensile strength and tensile modulus per the ASTM D4018 test method.

In a third aspect, the present disclosure relates to a method for controlling the degree of swelling of a polymer fiber, the method comprising adjusting the pH of the coagulation bath during spinning of the polymer fiber. As described herein, the pH of the coagulation bath affects the degree of swelling of the coagulated polymer fiber in a correlative manner.

In an embodiment, decreasing the pH of the coagulation bath increases the degree of swelling of the polymer fiber.

In another embodiment, increasing the pH of the coagulation bath decreases the degree of swelling of the polymer fiber.

In an embodiment, adjusting the pH of the coagulation bath comprises adding acid or base to the coagulation bath. Suitable acids or bases are described herein.

The processes and materials of the present disclosure are further illustrated by the following non-limiting examples.

Example 1. Effect of Coagulation Bath pH on Degree of Swelling

PAN polymer dope was spun into a coagulation bath (50:50 DMSO/water) maintained at constant temperature and concentration. At the beginning of the trial, a coagulated fiber and bath sample were taken. The bath pH was measured at 10.1. Acid (0.25 N $H_2SO_4$) was then added in small doses until the pH consistently measured about 8.0. A coagulated fiber sample was collected at this point. The bath was then lowered further to a pH of 6.3 where another fiber sample was collected. No further pH adjustments were made, and the trial continued where packages were collected to assess final carbon fiber properties. A final coagulated fiber sample was collected at the end of the trial. The coagulation bath pH and corresponding degree of swelling of the fiber samples are summarized in Table 1 below.

TABLE 1

| Coagulation bath pH | Degree of swelling |
|---|---|
| 10.1 | 102% |
| 8.0 | 112% |
| 6.3 | 138% |

The result shown in Table 1 shows that the coagulation bath pH affects the degree of swelling of the coagulated fiber and, more particularly, that a high coagulation bath pH leads to lower swelling while a low coagulation bath pH leads to higher swelling.

Generally, fibers with a degree of swelling ≥135% contain macrovoids which lowers the performance and tensile properties of the final carbon fiber. Optical microscopy images were taken of the fiber cross-sections to investigate the presence of macrovoids. Surprisingly, none of the samples collected contained macrovoids when examined by optical microscopy. This suggests that the pH change to the bath may have widened the acceptable processing window for macrovoid-free fiber.

Example 2. Manufacture of Carbon Fiber

The coagulated polymer fibers collected at low pH (6.3) were processed through oxidation and carbonization to produce carbon fiber. The final carbon fiber was characterized according to the ASTM D4018 test method. The average tensile strength measured was 717 ksi with an average modulus of 42.7 Msi.

Since no macrovoids were observed in the precursor fibers having high degree of swelling (138%) and tensile properties do not appear to have been suppressed in the corresponding final carbon fiber, this result suggests that control of the coagulation bath pH may allow for an increased 1st draw stretch with minimal damage.

What is claimed is:

1. A process for producing polymer fibers, the process comprising:

a) spinning a polymer solution into a coagulation bath, wherein the coagulation bath comprises one or more solvents; and b) maintaining the pH of the coagulation bath at a level effective to produce polymer fibers having a degree of swelling of less than or equal to 150%, wherein maintaining the pH of the coagulation bath at a level effective to produce polymer fibers having the said degree of swelling, comprises:

b1) determining the degree of swelling of the produced polymer fibers;

b2) adjusting the pH of the coagulation bath by adding an acid to maintain the pH of the coagulation bath in the range of about 4 to about 12, wherein the acid is selected from hydrochloric acid, nitric acid, sulfuric acid, hydrobromic acid, hydroiodic acid, perchloric acid, chloric acid, phosphoric acid, nitrous acid, hydrofluoric acid, formic acid, acetic acid, trifluoracetic acid; and b3) optionally, repeating steps b1) and b2).

2. The process of claim 1, wherein the polymer solution comprises acrylonitrile (AN) monomer, a co-monomer and a solvent.

3. The process of claim 2, wherein the polymer fibers produced are carbon fiber precursor fibers.

4. The process of claim 1, wherein the step of spinning a polymer solution into a coagulation bath comprises air gap spinning the polymer solution into the coagulation bath.

5. The process of claim 1, wherein the pH of the coagulation bath is maintained at a level effective to produce polymer fibers having a degree of swelling in a range from 90 to 150%.

6. The process of claim 1, wherein the pH of the coagulation bath is maintained at about 6 to about 11.

7. The process of claim 1, wherein the produced polymer fibers are substantially free of macrovoids.

8. A process for producing carbon fibers, the process comprising:

a') producing carbon fiber precursor fibers according to the process of claim 3;

b') drawing the carbon fiber precursor fibers through one or more draw and wash baths, thereby forming drawn carbon fiber precursor fibers that are substantially free of solvent; and c') oxidizing the drawn carbon fiber precursor fibers of step b') to form stabilized carbon fiber precursor fibers and then carbonizing the stabilized carbon fiber precursor fiber, thereby producing carbon fibers.

9. A process for producing polymer fibers, the process comprising:

a) spinning a polymer solution into a coagulation bath, wherein the coagulation bath comprises one or more solvents; and b) maintaining the pH of the coagulation bath at a level effective to produce polymer fibers having a degree of swelling of less than or equal to 150%, wherein maintaining the pH of the coagulation bath at a level effective to produce polymer fibers having the said degree of swelling, comprises:

b1) determining the degree of swelling of the produced polymer fibers;

b2) adjusting the pH of the coagulation bath by adding a base to maintain the pH of the coagulation bath in the range of about 4 to about 12, wherein the base is selected from metal hydroxides and ammonia; and b3) optionally, repeating steps b1) and b2).

10. The process of claim 9, wherein the polymer solution comprises acrylonitrile (AN) monomer, a co-monomer a polyacrylonitrile-based polymer and a solvent.

11. The process of claim 10, wherein the polymer fibers produced are carbon fiber precursor fibers.

12. The process of claim 9, wherein the step of spinning a polymer solution into a coagulation bath comprises air gap spinning the polymer solution into the coagulation bath.

13. The process of claim 9, wherein the pH of the coagulation bath is maintained at a level effective to produce polymer fibers having a degree of swelling in a range from 90 to 150%.

14. The process of claim 9, wherein the pH of the coagulation bath is maintained at about 6 to about 11.

15. The process of claim 9, wherein the produced polymer fibers are substantially free of macrovoids.

* * * * *